US006364631B1

(12) United States Patent
Blass et al.

(10) Patent No.: US 6,364,631 B1
(45) Date of Patent: Apr. 2, 2002

(54) PUMP APPARATUS FOR HYDRAULICALLY POWERED FUEL INJECTION SYSTEMS

(75) Inventors: James R. Blass, Bloomington; Dennis H. Gibson, Chillicothe; Mark F. Sommars, Sparland; Eric S. Keyster, Peoria, all of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/388,109

(22) Filed: Sep. 1, 1999

Related U.S. Application Data

(60) Provisional application No. 60/098,866, filed on Sep. 2, 1998.

(51) Int. Cl.[7] ..... F04B 17/00; F04B 35/00

(52) U.S. Cl. ..... 417/364; 123/446

(58) Field of Search ..... 417/362, 364, 417/297, 307, 269, 271, 440; 123/446

(56) References Cited

U.S. PATENT DOCUMENTS

| | | | | | |
|---|---|---|---|---|---|
| 3,597,115 | A | | 8/1971 | Jass | 417/313 |
| 3,768,929 | A | | 10/1973 | Kemp et al. | 417/270 |
| 3,927,954 | A | * | 12/1975 | Walker | 417/360 |
| 4,518,319 | A | | 5/1985 | Ring | 417/217 |
| 4,566,416 | A | | 1/1986 | Berchtold | |
| 4,752,192 | A | | 6/1988 | Ode | 417/271 |
| 4,784,088 | A | * | 11/1988 | Tamba et al. | 123/41.47 |
| 4,879,981 | A | * | 11/1989 | Matsumoto | 123/198 |
| 5,125,795 | A | * | 6/1992 | Suzuki et al. | 415/168.2 |
| 5,154,576 | A | * | 10/1992 | Dorski et al. | 417/423 |
| 5,191,867 | A | | 3/1993 | Glassey | |
| 5,324,176 | A | | 6/1994 | Farrell | 417/364 |
| 5,357,912 | A | | 10/1994 | Barnes et al. | |
| 5,485,820 | A | | 1/1996 | Iwaszkiewicz | |
| 5,509,391 | A | * | 4/1996 | Degroot | 123/467 |
| 5,511,956 | A | * | 4/1996 | Hasegawa et al. | 417/271 |
| 5,515,829 | A | | 5/1996 | Wear et al. | 123/446 |
| 5,700,136 | A | * | 12/1997 | Sturman | 417/270 |
| 5,788,469 | A | | 8/1998 | Novacek et al. | |
| 5,795,137 | A | * | 8/1998 | Ozawa et al. | 417/362 |
| 6,071,091 | A | * | 6/2000 | Lemieux | 417/423 |
| 6,092,997 | A | * | 7/2000 | Kimura et al. | 417/269 |

FOREIGN PATENT DOCUMENTS

| | | |
|---|---|---|
| EP | 0 723 077 A1 | 7/1996 |

* cited by examiner

*Primary Examiner*—Charles G. Freay
*Assistant Examiner*—William Rodriguez
(74) *Attorney, Agent, or Firm*—Liell & McNeil

(57) ABSTRACT

A pumping system for supplying high pressure actuation fluid to individual fuel injectors of an engine equipped with a hydraulically-actuated fuel injection system wherein the three major elements of the system, namely, the pump, the rail pressure control valve and the bleed-off sump or reservoir are physically separated and spaced from one another. The pump is annular, having a central opening through which the engine crankshaft passes. The crankshaft and pump wobble plate are rotationally coupled by opposing flats on each. The pump, rail pressure control valve and reservoir are mounted directly to the engine, receiving and discharging fluid through internal engine passageways, thereby eliminating the usual tubing, and fittings. The pump itself is compact and relatively short in the axial direction, leaving space for mounting such things as a cylindrical housing having belt grooves in its outer surface and a viscous damper on the crankshaft between the pump and the terminal crankshaft end.

9 Claims, 2 Drawing Sheets

12
20
4
16
24
18
16
12'
22
4

12
28
33
30
18
16
24
12'
20
32
26
16
36
34
35

20
12
16
16
18
12'

PUMP APPARATUS FOR HYDRAULICALLY POWERED FUEL INJECTION SYSTEMS

CROSS REFERENCE TO RELATED APPLICATIONS

This application claims the benefit of prior provisional patent application serial No. 60/098,866 filed Sep. 2, 1998.

TECHNICAL FIELD

The present invention relates to engines having hydraulically-actuated fuel injection systems and, more specifically, to pumping systems for such engines.

BACKGROUND ART

Internal combustion engines equipped with a hydraulically-actuated fuel injection system (HEUI fuel system) employ an actuating pump to provide actuating fluid at elevated pressures to injectors, thus elevating the pressure of the fuel being injected into the engine. Control of the fuel injection pressure is achieved by controlling the pressure of the actuating fluid, hereinafter referred to for convenience simply as "oil." Typically, control of the oil pressure is achieved by employing a fixed displacement pump to elevate the fluid pressure and regulating that pressure to lower levels by bleeding off unneeded flow volume through a rail pressure control valve (RPCV), past which the unneeded oil returns to a sump or reservoir.

In conventional HEUI systems, the pump, RPCV and reservoir are physically associated so as to form, in effect, a single unit which is mounted to the engine. Oil at low pressure is supplied from the engine to the pump through hydraulic tubing connected by suitable fitting to the engine and to the low pressure inlet of the pump. After elevation of pressure by the pump, the oil passes through the RPCV, and thence back to the reservoir or, through additional hydraulic tubing, to the high pressure manifold (rail).

Examples of hydraulically-actuated fuel injection systems are shown in U.S. Pat. No. 5,191,867 issued to Glassey, et al on Mar. 9, 1993, and U.S. Pat. No. 5,213,083 issued to Glassey on May 25, 1993; a variable-displacement pump for an HEUI fuel system is shown in U.S. Pat. No. 5,515,829 issued to Wear, et al on May 14, 1996, all of which are assigned to the assignee of the present invention. Pumps for HEUI fuel systems, as well as other rotary, engine-operated pumps, e.g., power steering pumps, typically have a pump shaft which is coupled to the engine crankshaft by appropriate connecting mechanism. Such a pump, mounted to a bracket and spaced forwardly of the engine and terminal end of the crankshaft, is shown in U.S. Pat. No. 3,927,954 issued to Walker on Dec. 23, 1975. This patent also shows a cylindrical housing with external belt grooves mounted upon the crankshaft between the engine and the pump and partially enclosing the pump.

The present invention is directed to solving various packaging and placement problems that occur when placing an HEUI system on a relatively small engine. Additionally, the invention is directed to providing a more cost effective and aesthetically improved design, and to overcoming one or more of the problems or concerns set forth above.

DISCLOSURE OF THE INVENTION

The present invention physically separates the three main components, namely the pump, the RPCV and the reservoir, of the HEUI system. The pump is mounted in encircling relation to the engine crankshaft for direct drive of the movable pump components which are keyed to the crankshaft. The low pressure inlet and high pressure outlet of the pump communicate directly with internal passages in the engine block, thus eliminating the need for hydraulic tubing between the pump and engine. Also, the inlet and outlet of the RPCV communicate directly with the engine block passages. Cold start oil volume in the rail is provided by mounting the reservoir at a slightly higher elevation than the rail instead of by a diaphragm mechanism in the pump. Further features are the provision of a hydrostatic thrust bearing to carry the thrust load of both sides of the wobble plate, and the mounting of other components, including a cylindrical housing with pulley grooves on its outer surface substantially enclosing the pump housing, on the crankshaft end extending through the pump.

BEST MODE FOR CARRYING OUT THE INVENTION

Figure 1:
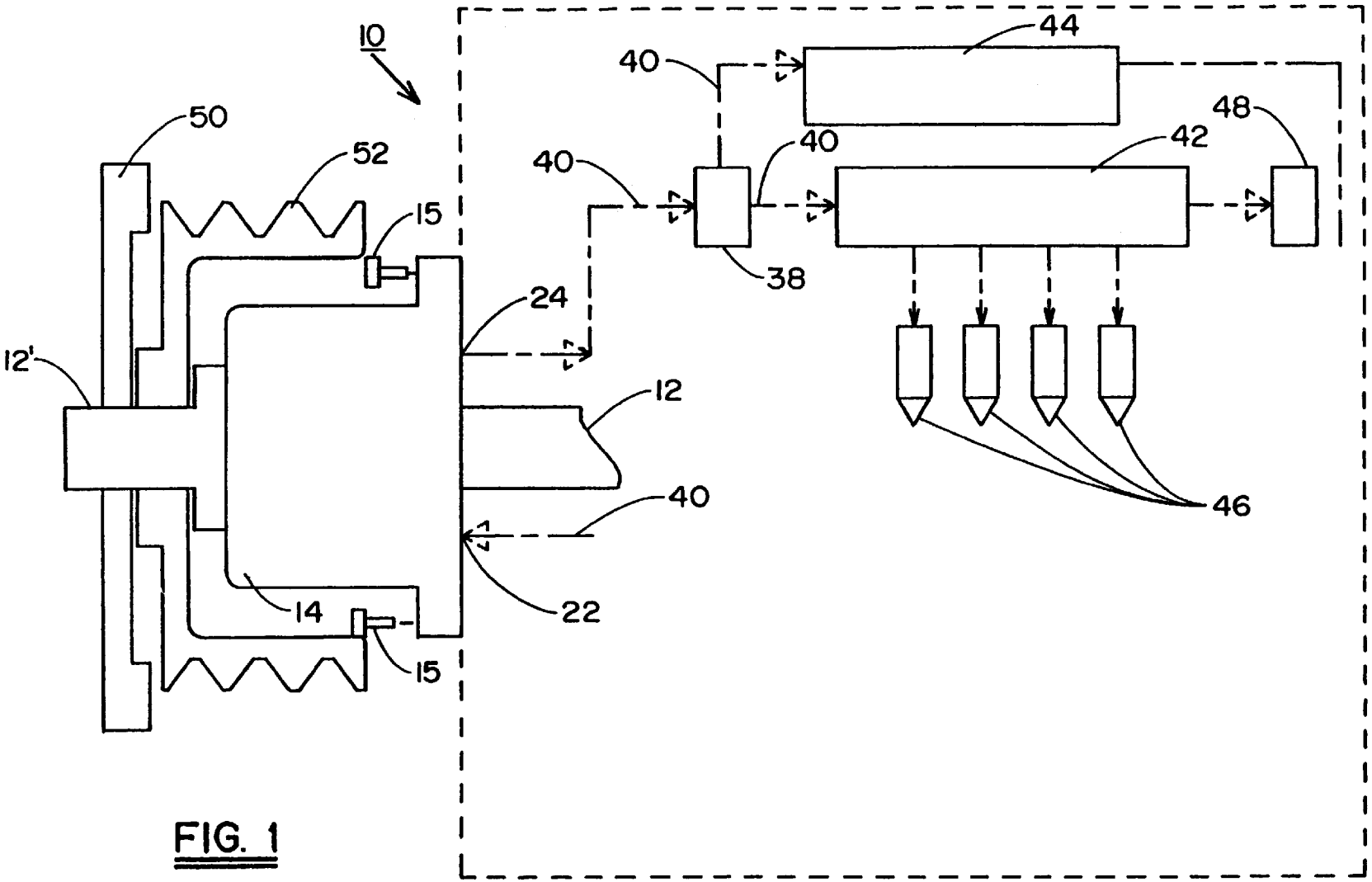
FIG. 1 is a diagrammatic illustration of the components of the invention.

In the diagrammatic illustration of FIG. 1, a fragment of an internal combustion engine is indicated generally by the dotted line 10. Engine 10 includes the usual crankshaft 12, having a portion rotatably driven by action of the pistons and connecting rods (not shown). Crankshaft 12 extends completely through pump 14 to a terminal end, indicated by reference numeral 12', spaced outwardly from the pump. Pump 14 is secured to engine 10 by bolts 15 passing through openings 16 in flange 18 of pump housing 20 and into tapped openings in the engine block. Pump 14 receives low pressure oil from engine 10 through inlet port 22 and discharges high pressure oil through outlet port 24. The engine block is so configured that inlet and outlet ports 22 and 24, respectively, are in direct communication with corresponding ports on the block, thereby eliminating the need for the hydraulic tubing which normally provides such communication.

Figures 2, 3, 4:
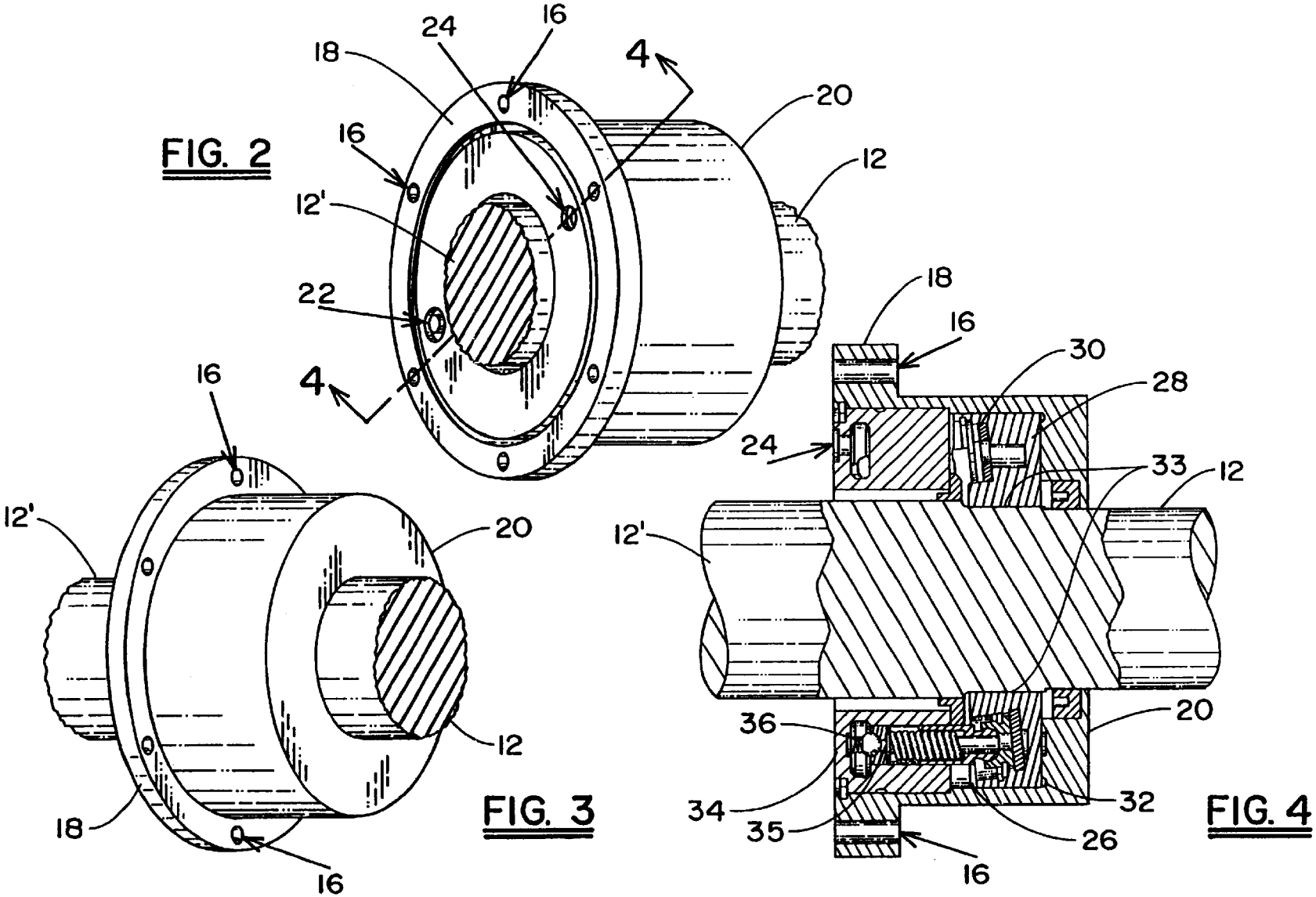
FIGS. 2 and 3 are perspective views of the pump unit of the invention, taken from opposites sides, and a portion of the engine crankshaft.
FIG. 4 is a side elevational view in section on the line 4—4 of FIG. 2.

Referring now to FIG. 4, low pressure oil fills the pump cavity surrounding plungers 26, only one of which is seen, but a plurality of which are arranged about the central axis of pump 14 in conventional fashion. Oil is drawn into plungers 26 during the suction stroke through a groove in wobble plate 28. The timing in degrees (e.g., 180) of the filling cycle is determined by a groove in wear plate 30. Wobble plate 28 is rotated by crankshaft 12 by being keyed thereto or by means of mating flats on the crankshaft and wobble plate, the latter being held in place by hydrostatic bearing 32. For the remainder of each complete revolution, pump 14 is displacing high pressure oil into the high pressure annulus located in barrel 34. Check valve 36 prevents leakage of high pressure oil back into the plungers during the suction stroke. Outlet port 24 is in direct communication with the high pressure annulus, thus allowing exit of the high pressure oil to engine 10.

Referring again to FIG. 1, high pressure oil travels through an internal passageway in the engine block to RPCV 38. Internal passageways in the engine block are indicated by dash-dot lines denoted by reference numeral 40. From RPCV 38, oil passes to high pressure manifold or rail 42 with oil in excess of that required to maintain pressure in rail 42 at the desired level being bled off to reservoir 44, the latter being mounted to engine 10 at a slightly higher level than rail 42. Oil from rail 42 is applied to hydraulically powered fuel injectors 46 in the usual manner. Conventional pressure relief valve 48 is also connected to rail 42. As also seen in FIG. 1, between pump 14 and terminal end 12', crankshaft 12 carries viscous damper 50 and cylindrical housing 52, the latter having grooves in its outer surface for drive belts connected to the engine fan, alternator, air conditioning compressor, and/or other accessories. A major portion of pump 14 is surrounded by housing 52 and thus concealed from view.

INDUSTRIAL APPLICABILITY

The pump apparatus of the invention and its physical relation to the engine with which it is associated contribute to elimination of various packaging and placement problems common to mounting of HEIU pumps on small engines. The separation of the three major components of the pump system, i.e., the rail pressure control valve (RPCV), the pump reservoir, and the pump proper, allows for a short, compact pump mounted directly to the engine and driven directly by the crankshaft. All components are engine-mounted, with fluid inlets and outlets in direct communication with passageways in the engine block, thereby eliminating the need for any hydraulic tubing and associated connectors, fittings, etc. The axially short pump design permits the crankshaft to extend entirely through the pump housing and permit mounting thereon of additional driven components.

The RPCV is mounted on the engine near, and in fluid communication with the high pressure rail. The reservoir is mounted at a slightly higher level than the high pressure rail. The pump package is reduced by this separation since the need for cold start oil volume in the rail is held by elevation of the reservoir instead of a diaphragm mechanism in the pump.

This invention has been described in the specification and illustrated in the drawings with reference to a preferred embodiment, the structure of which has been disclosed herein. However, it will also be understood by those skilled in the art to which this invention pertains that various changes or modifications may be made and equivalents may be substituted for elements of the invention without departing from the scope of the claims. Therefore, it is intended that the invention not be limited to the particular embodiment disclosed in the specification and shown in the drawings as the best mode presently known by the inventors for carrying out this invention, nor confined to the details set forth in the preferred embodiment, but that the invention shall include all embodiments, modifications and changes as may come within the scope of the following claims.

What is claimed is:

1. A pump system for supplying high-pressure fluid to a hydraulically-actuated fuel injection system of an internal combustion engine having a crankshaft, a high pressure rail for receiving high pressure fluid and supplying it to hydraulically powered fuel injectors, and internal fluid passageways, said pump system comprising:

a pump having a housing and an annular flange surrounding a portion of said crankshaft, a low pressure fluid inlet port, a wobble plate within said housing rotatable about a central axis to raise the pressure of fluid within said housing, and a high pressure fluid outlet port;

said pump mounted directly to, and with said annular flange abutting, said engine with said inlet and outlet ports being surrounded by said annular flange and in direct communication with a first and a second one of said internal fluid passageways, respectively;

a rail pressure control valve physically separated and spaced from said pump and having an inlet communicating directly with said second fluid passageway, a first outlet communicating with said high pressure rail, and a second outlet; and a fluid reservoir physically separated and spaced from both said pump and said rail pressure control valve and having an inlet communicating with said rail pressure control valve second outlet to receive from said rail pressure control valve fluid in excess of that required to maintain the pressure of fluid in said high pressure rail at a desired level.

2. The pump system of claim 1 wherein said crankshaft extends into said pump housing and is coupled to said rotatable wobble plate for rotation thereof in response to rotation of said crankshaft.

3. The pump system of claim 2 wherein said crankshaft extends from said engine, through said pump housing to a terminal end spaced outwardly from said pump housing.

4. The pump system of claim 3 further including at least one component mounted upon said crankshaft between said pump housing and said terminal end for rotation of said component in response to rotation of said crankshaft.

5. The pump system of claim 4 wherein said component is a viscous damper.

6. The pump system of claim 4 wherein said component includes a cylindrical housing surrounding a major portion of said pump housing in spaced relation thereto.

7. The pump system of claim 6 wherein said cylindrical housing includes at least one groove in its outer surface for receiving a drive belt.

8. The pump system of claim 1 wherein said reservoir is mounted at a vertically higher level than said high pressure rail.

9. The pump system of claim 1 further including a hydrostatic thrust bearing supporting said wobble plate.

* * * * *